United States Patent [19]

Ampferer

[11] Patent Number: 4,759,317

[45] Date of Patent: Jul. 26, 1988

[54] MULTI-CYLINDER INTERNAL COMBUSTION ENGINE

[75] Inventor: Herbert Ampferer, Sachsenheim, Fed. Rep. of Germany

[73] Assignee: Dr. Ing. h.c.F. Porsche Aktiengesellschaft, Weissach, Fed. Rep. of Germany

[21] Appl. No.: 11,700

[22] Filed: Feb. 6, 1987

[30] Foreign Application Priority Data

Feb. 6, 1986 [DE] Fed. Rep. of Germany ..... 3603674

[51] Int. Cl.[4] ..... F01P 3/02; F02F 1/38

[52] U.S. Cl. ..... 123/41.74; 123/41.82 R; 123/41.84

[58] Field of Search ..... 123/41.74, 41.82 R, 123/41.84, 41.72, 41.83

[56] References Cited

U.S. PATENT DOCUMENTS

| | | | |
|---|---|---|---|
| 2,089,454 | 8/1937 | Walden | 123/41.74 |
| 2,710,602 | 6/1955 | Maybach | 123/41.82 R |
| 4,131,093 | 12/1978 | Mansfield | 123/41.82 R |
| 4,284,037 | 8/1981 | Kasting et al. | 123/41.82 R |
| 4,539,942 | 9/1985 | Kobayashi et al. | 123/41.82 R |
| 4,579,091 | 4/1986 | Kashiwagi et al. | 123/41.82 R |

FOREIGN PATENT DOCUMENTS

| | | |
|---|---|---|
| 2411493 | 10/1974 | Fed. Rep. of Germany . |
| 2429355 | 1/1975 | Fed. Rep. of Germany . |
| 2950905 | 6/1980 | Fed. Rep. of Germany . |

*Primary Examiner*—Willis R. Wolfe
*Attorney, Agent, or Firm*—Barnes & Thornburg

[57] ABSTRACT

A multi-cylinder internal combustion engine with liquid cooling comprises a cylinder head and a cylinder crankcase connected with the cylinder head; the crankcase includes cylinder liners circumcirculated by the cooling medium. For reducing the weight of the internal combustion engine, the cooling medium quantity is reduced and the cylinder head and the cylinder liners are acted upon with cooling medium by a cross-flow cooling system. Additionally, an internal combustion engine unit of relatively short construction and relatively light weight is created by the particular construction of the cylinder liners.

21 Claims, 3 Drawing Sheets

MULTI-CYLINDER INTERNAL COMBUSTION ENGINE

The present invention relates to a multi-cylinder internal combustion engine with a liquid cooling system, a cylinder head, and a cylinder crankcase connected with the cylinder head, which includes cylinder liners circumcirculated by the cooling medium.

Internal combustion engines which are optimized as regards weight and dimensions, i.e., of light-weight and compact construction, enhance the aims in the automobile construction to limit, respectively, reduce manufacturing costs and operating costs of passenger motor vehicles. In internal combustion engines, not only large cylinder spacings ("Die Konstruktion schnellaufender Verbrennungsmotoren" [The Construction of High-Speed Combustion Engines] by Walter de Gruyter, Berlin-New York, 1973, page 21) but also oversized cooling medium channels and the medium quantity circulating therein can become effective in increasing the weight.

It is the object of the present invention to provide an internal combustion engine which, with a functionally correct cooling, is light weight and compact.

The underlying problems are solved according to the present invention in that the cooling medium for the individual cylinders is conducted transversely to the longitudinal direction of the internal combustion engine through the cylinder head and past the cylinder liners of the cylinder crankcase whereby the cooling medium flows from a feed channel to a discharge channel.

The principal advantages achieved with the present invention reside in that a channel system which surrounds in an operationally correct manner the particular warm areas of the internal combustion engine, can be realized for a relatively small cooling medium volume by the cooling medium guidance transversely to the longitudinal direction of the internal combustion engine which has a weight-reducing effect. It is additionally achieved by the reduced cooling medium volume that the internal combustion engine reaches rapidly its operating temperature which affects favorably the fuel consumption and the exhaust gas emission.

A separate cooling medium supply of the cylinder head and of the cylinder liners which is correct as regards requirements is possible by means of the feed channel. The feed channel and the discharge channel are adapted to be provided in a simple manner between the mentioned internal combustion engine components. Cross bores which serve for the connection of the feed channel with the annular channels of the cylinder liners, not only can be machined easily by way of the recesses, but can also be utilized, in case of need, for calibrating the cooling medium flow, for example, for internal combustion engines of different power outputs. By reason of the arrangement of the feed channel adjacent the exhaust valves, the principle is additionally assisted to cool intentionally warm zones of the internal combustion engines. The differing volume of the medium chambers of the inlet and exhaust valves also contributes thereto.

The type of the arrangement of the separate cylinder liners which are inserted in recesses of the cylinder crankcase enables relatively small cylinder spacings and reduces the structural length of the internal combustion engine which also becomes effective in a weight-reducing manner. The narrow area between the cylinder liners in which a groove is provided can be effectively sealed off by means of the one-piece metallic cylinder head seal. Finally, the seal sections of the cylinder head seal simplify the seal between cylinder head and cylinder crankcase within the area of the feed and discharge channel.

These and other objects, features and advantages of the present invention will become more apparent from the following description when taken in connection with the accompanying drawing which shows, for purposes of illustration only, two embodiments in accordance with the present invention, and wherein.

Figure 1:
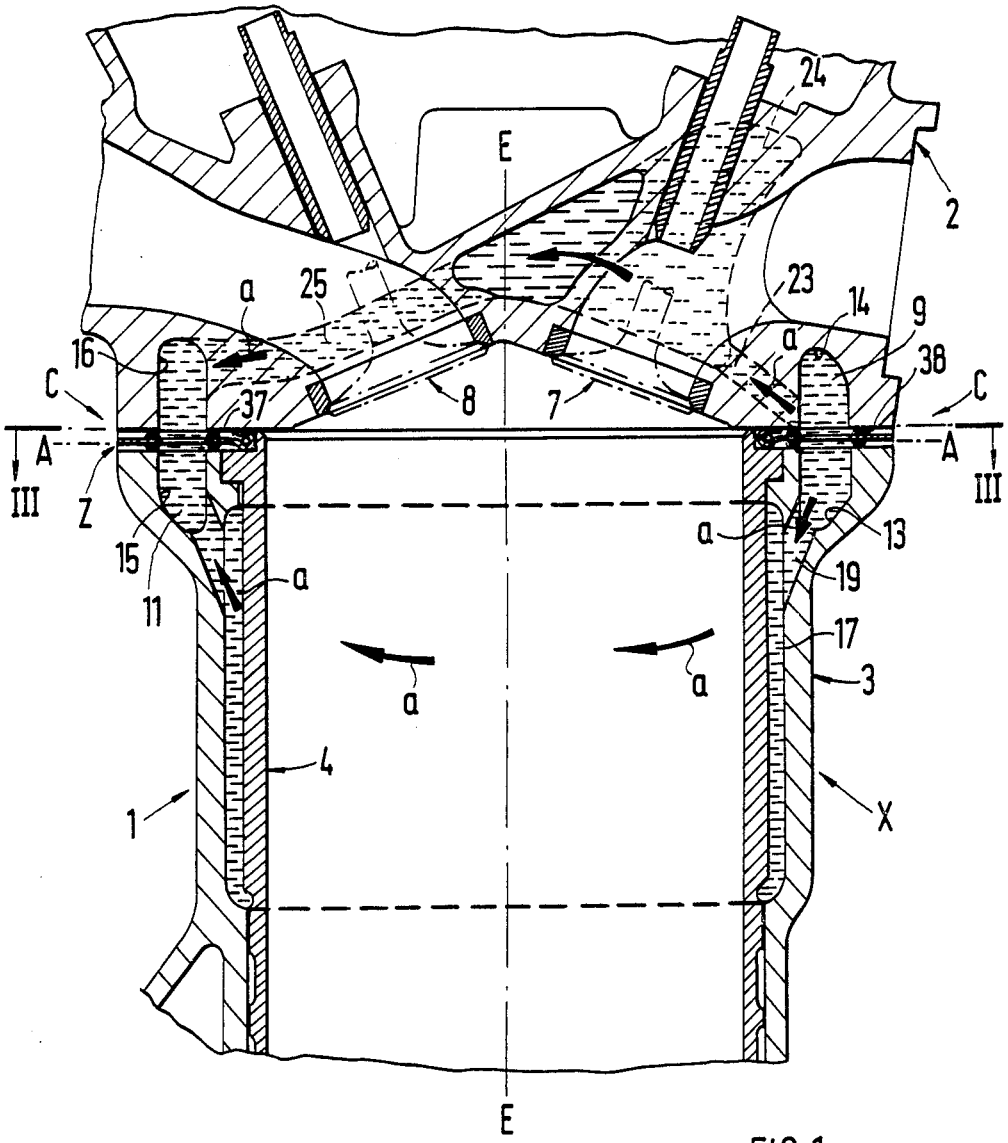
FIG. 1 is a partial cross-sectional view of an internal combustion engine in accordance with the present invention within the area of a cylinder head and a cylinder crankcase.
Figure 2:
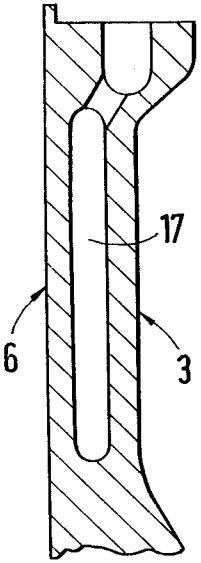
FIG. 2 is a partial cross-sectional view of a modified construction of a detail indicated by reference character X in FIG. 1.

Referring now to the drawing wherein like reference numerals are used throughout the various views to designate like parts, the multi-cylinder liquid-cooled internal combustion engine includes a cylinder head generally designated by reference numeral 2 and a cylinder crankcase generally designated by reference numeral 3; both the cylinder head 2 and the cylinder crankcase 3 are assembled within a horizontal connecting plane A—A and are retained in position by means of bolts (not shown). Several cylinder liners 4, 5 consisting, for example, of gray cast iron are provided in the crankcase 3 which according to FIG. 1 are formed by separate components inserted into the crankcase 3. According to FIG. 2, the cylinder liner 6 is connected in one piece—cast together—with the cylinder crankcase 3.

The cylinder head 2 includes exhaust valves 7 and inlet valves 8 which extend V-shaped with respect to one another and are actuated by means of cam shafts (not shown). For cooling the internal combustion engine, the latter includes along its longitudinal side—as viewed in the longitudinal direction B—B (FIG. 2) of the internal combustion engine—a feed channel 9 which includes an inlet at 10 where the liquid cooling medium enters which is fed by a water pump (not shown). From this feed channel 9, the cooling medium is conducted transversely to the longitudinal direction B—B through the cylinder head 2 and past the cylinder liners 4, 5, 6—cross-flow cooling—and reaches the discharge channel 11 whose outlet is designated by reference numeral 12 and from where the cooling medium flows to a radiator (not shown). The flow of the cooling medium is indicated by arrows "a". In the illustrated embodiment, the inlet 10 and the outlet 12 are coordinated to the cylinder crankcase 3. However, they may also be provided at the cylinder head 2.

The feed channel 9 and the discharge channel 11 are integrated into the internal combustion engine and extend along the longitudinal sides C and D (FIG. 2) between the cylinder head 2 and the cylinder crankcase 3. The feed channel 9 and discharge channel 11 are formed by recesses 13, 14 and 15, 16 in the cylinder head 2 and in the cylinder crankcase 3, whereby the recesses 13, 14 and 15, 16 are machined into the respective internal combustion engine components from the connecting plane A—A.

Figure 3:
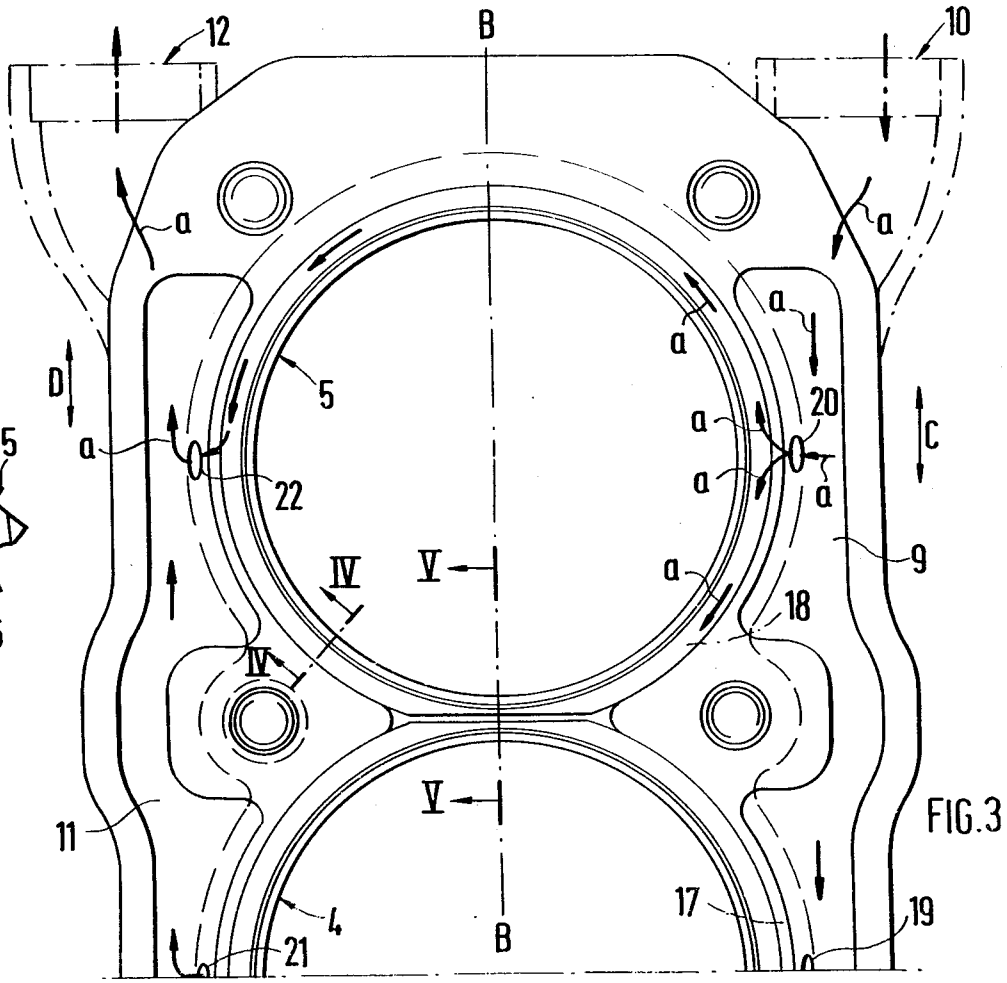
FIG. 3 is a cross-sectional view taken along line III—III of FIG. 1.

Cross bores 19 and 20 are provided between the feed channel 9 and the annular channels 17 and 18 surrounding the cylinder liners 4, 5 and 6 (FIGS. 1 and 3). Further cross bores 21 and 22 connect the annular channels 17 and 18 with the discharge channel 11. The cross bores 19, 20 and 21, 22 are machined by way of the recesses 13 and 15 whereby their machining direction extends obliquely to a center longitudinal plane E—E of the internal combustion engine 1 (FIG. 1). The feed channel 9 extends adjacent the exhaust valves 7. The cooling medium reaches from the feed channel 9 by way of cross bores 23 the medium chambers 24 surrounding the exhaust valves 7 and then flows into the discharge channel 11 after passing beforehand through the medium chambers 25 above the inlet valves 8. The medium chambers 24 of the exhaust valves 7 are larger as regards volume by reason of the temperature conditions prevailing thereat than the medium chambers 25 of the inlet valves 8.

Figure 8:
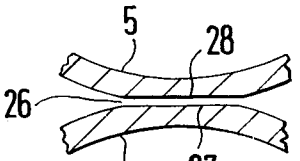
FIG. 8 is a cross-sectional view taken along line VIII—VIII of FIG. 5.
Figure 6:
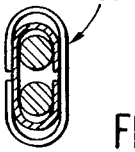
FIG. 6 is a cross-sectional view of the detail Y of FIG. 5, on an enlarged scale.
Figure 5:
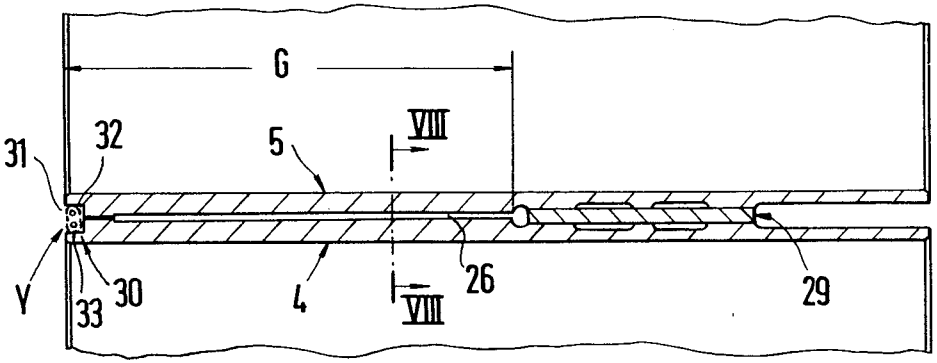
FIG. 5 is a cross-sectional view, taken along line V—V of FIG. 3.

Adjacent the cylinder head 2, the cylinder liners 4 and 5 are positioned directly one against the other over a significant partial area of their entire length—which is approximately the length G (=more than half the entire length of the cylinder liners)—whereby, however, a small spacing 26 for the through-flow of the medium is provided between the cylinder liners 4 and 5 (FIG. 5). Within this area, the cylinder liners 5 have flattened-off portions 27 and 28 and essentially the same wall thicknesses. The flattened off portions 27 and 28 are formed by reductions in the wall thickness (FIG. 8).

Recesses generally designated by reference numeral 29 (FIG. 5) of the cylinder crankcase 3 extend adjoining this area, i.e., remote from the cylinder head 2, into which the cylinder liners 4 and 5 are fitted in. The wall thicknesses of the cylinder liners 4 and 5 and of the recesses 29 are approximately the same. Additionally, the wall thicknesses of the cylinder liners 4, 5 and of the recesses 29 are optimized in the area of the cylinder liners where they are placed one adjacent the other, i.e., with good strength are made as thin-walled as possible.

A groove 30 is provided (FIG. 5) between the cylinder liners 4 and 5, and more particularly adjacent the cylinder head 2, into which a one-piece metallic cylinder head seal 31 is inserted. The groove 30 is formed by angular recesses 32 and 33 of the cylinder liners 4 and 5.

Figure 4:
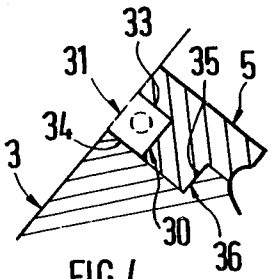
FIG. 4 is a cross-sectional view, on an enlarged scale, taken along line IV—IV of FIG. 3.

The groove 30 is extended outside of the mutually facing cylinder liners 4 and 5 (FIG. 4) where it is represented by a wall 34 of the cylinder crankcase 3 and the respective recess 32 or 33 of the cylinder liners 4, 5. A collar 35 is provided at the cylinder liners 4, 5 at a distance to the recesses 32 and 33 which abuts at a support 36 of the cylinder crankcase 3.

Figure 7:
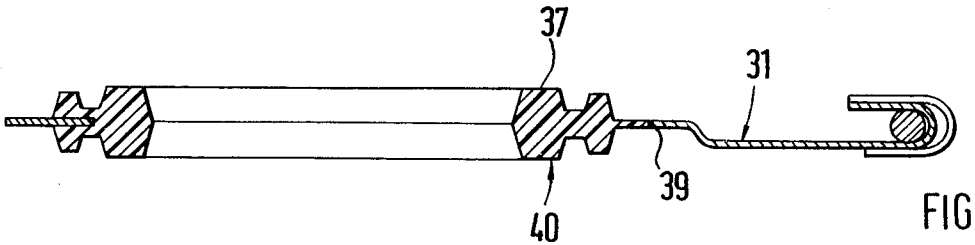
FIG. 7 is a cross-sectional view of the detail Z of FIG. 1, on an enlarged scale.

The cylinder head seal 31 (FIG. 7) is provided with sealing sections 37 and 38. The latter are effective between cylinder head 2 and cylinder crankcase 3, and more particularly within the area of the feed channel 9 and of the discharge channel 11. The seal sections 37 and 38 include a metallic extension 39 of the cylinder head seal 31 which carries a sealing body 40 of elastic material—silicon.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A multi-cylinder internal combustion engine with liquid cooling, comprising cylinder head means, cylinder crankcase means connected with the cylinder head means and including cylinder liner means circumcirculated by cooling medium, the cooling medium for the individual cylinders being conducted transversely to the longitudinal directions of the internal combustion engine to the cylinder head means and past the cylinder liner means of the cylinder crankcase means, the cooling medium flowing from a feed channel means into a discharge channel means, wherein the cylinder liner means are inserted into the recesses of the cylinder crankcase means, wherein the cylinder liner menans; beginning adjacent the cylinder head means are positioned directly adjacent the other with a small spacing therebetween over a significant partial area of their length and possess within said partial area essentially the same wall thickness, and wherein the recesses of the cylinder crankcase means extend in an area adjacent the partial area, and wherein a groove formed by recesses of the cylinder liner means is provided between the cylinder liner means adjacent the cylinder head means, and wherein a one-piece metallic cylinder head seal means is inserted into said groove.

2. A multi-cylinder internal combustion engine according to claim 1, wherein the groove is extended outside of the mutually facing sides of the cylinder liner means and is formed thereat by a wall of the cylinder crankcase means and the respective recess of the cylinder liner means.

3. A multi-cylinder internal combustion engine according to claim 2, wherein each cylinder liner means includes a collar adjacent the last-mentioned recess, which abuts at a support of the crankcase means.

4. A multi-cylinder internal combustion engine according to claim 1, wherein the cylinder head seal means includes seal sections which are effective between the cylinder head means and cylinder crankcase means within the area of the feed channel means and the discharge channel means.

5. A multi-cylinder internal combustion engine according to claim 4, wherein the seal sections include metallic extensions of the cylinder head seal means which carry a seal member of elastic material.

6. A multi-cylinder internal combustion engine with liquid cooling, comprising cylinder head means, cylinder crankcase means connected with the cylinder head means and including cylinder liner means circumcirculated by cooling medium, the cooling medium for the individual cylinders being conducted transversely to the longitudinal directions of the internal combustion engine to the cylinder head means and past the cylinder liner means of the cylinder crankcase means, the cooling medium flowing from a feed channel means extending in the engine longitudinal direction along one engine lateral side into a discharge channel means extending in the engine longitudinal direction along an opposite engine lateral side.

7. A multi-cylinder internal combustion engine according to claim 6, wherein the cylinder head means and the cylinder liner means are supplied with cooling medium separately from one another, such that the cooling medium flow from the feed channel means to the discharge channel means is over separate paths for the cooling medium supplied around the cylinder head means and the cooling medium surrounded around the cylinder liner means.

8. A multi-cylinder internal combustion engine according to claim 6, wherein the feed channel means is connected by way of cross bores with annular channels surrounding the cylinder liner means.

9. A multi-cylinder internal combustion engine according to claim 6, whose cylinder head means includes suspended inlet and exhaust valves, wherein the feed channel means is arranged adjacent the exhaust valves and the cooling medium flows initially by way of cross bores into medium chambers surrounding the exhaust valves and thereupon into medium chambers surrounding the inlet valves, from where it reaches the discharge channel means.

10. A multi-cylinder internal combustion engine according to claim 9, wherein the volume of the medium chambers of the exhaust valves is larger than the volume of the medium chambers of the inlet valves.

11. A multi-cylinder internal combustion engine according to claim 9, wherein the inlet and exhaust valves are arranged suspended V-shaped to one another.

12. A multi-cylinder internal combustion engine according to claim 6, whose cylinder liner means are inserted into recesses of the cylinder crankcase means, wherein the cylinder liner means; beginning adjacent the cylinder head means are positioned one directly adjacent the other with a small spacing therebetween over a significant partial area of their length and possess within said partial area essentially the same wall thicknesses, and wherein the recesses of the cylinder crankcase means extend in an area adjacent the partial area.

13. A multi-cylinder internal combustion engine according to claim 12, wherein the recesses of the crankcase means and the wall thicknesses of the cylinder liner means adjoining the same are substantially similar.

14. A multi-cylinder internal combustion engineer according to claim 12, wherein a groove formed by recesses of the cylinder liner means is provided between the cylinder liner means adjacent the cylinder head means, and wherein a one-piece metallic cylinder head seal means is inserted into said groove.

15. A multi-cylinder internal combustion engine according to claim 12, wherein the cylinder liner means include flattened off portions along the sides mutually facing one another.

16. A multi-cylinder internal combustion engine according to claim 15, wherein the flattened off portions are formed by reductions of the wall thicknesses of the respective cylinder liner means.

17. A multi-cylinder internal combustion engine according to claim 6, wherein the feed channel means and the discharge channel means are integrated into the internal combustion engine and are formed by recesses in the cylinder head means and in the crankcase means, the recesses being machined from a connecting plane between the cylinder head means and the cylinder crankcase means.

18. A multi-cylinder internal combustion engine according to claim 17, wherein the feed channel means and the discharge channel means are integrated into the internal combustion engine at its longitudinal sides.

19. A multi-cylinder internal combustion engine according to claim 17, wherein the feed channel means is connected by way of cross bores with annular channels surrounding the cylinder liner means.

20. A multi-cylinder internal combustion engine according to claim 19, wherein the annular channels are connected with the discharge channel means by way of cross bores.

21. A multi-cylinder internal combustion engine according to claim 20, wherein the cross bores are machined by way of the recesses.

* * * * *